US006351893B1

(12) United States Patent
St. Pierre

(10) Patent No.: US 6,351,893 B1
(45) Date of Patent: Mar. 5, 2002

(54) SELF SQUARING ACCIDENT DIAGRAMMING TEMPLATE

(76) Inventor: Garrick St. Pierre, 2219 Fair Park Blvd., Little Rock, AR (US) 72204

( * ) Notice: Subject to any disclaimer, the term of this patent is extended or adjusted under 35 U.S.C. 154(b) by 0 days.

(21) Appl. No.: 09/455,862

(22) Filed: Dec. 7, 1999

(51) Int. Cl.[7] ..... B43L 13/20

(52) U.S. Cl. ..... 33/563; 33/16; 33/474

(58) Field of Search ..... 33/562, 563, 565, 33/566, 1 G, 1 BB, 1 B, 474, 476, 429; D10/64, 61; D19/35, 37, 39, 40

(56) References Cited

U.S. PATENT DOCUMENTS

| | | | | | |
|---|---|---|---|---|---|
| 147,942 | A | * | 2/1874 | Hutchinson | 33/563 |
| 1,544,327 | A | * | 6/1925 | Loewenthal | 33/562 |
| 1,604,232 | A | * | 10/1926 | Lipke | 33/1 B |
| 1,633,163 | A | * | 6/1927 | Crouse | 33/565 |
| 1,708,551 | A | * | 4/1929 | Nell | 33/563 |
| 3,371,420 | A | * | 3/1968 | Pane, Jr. | 33/562 |
| D249,271 | S | | 9/1978 | Boarman | |
| 4,524,522 | A | | 6/1985 | Perry | |
| D284,089 | S | | 6/1986 | Hines | |
| 4,815,212 | A | | 3/1989 | Wood | |
| 4,870,759 | A | | 10/1989 | Burton et al. | |
| 4,916,827 | A | | 4/1990 | Rayburn | |
| 4,936,020 | A | * | 6/1990 | Neblett | 33/566 |
| D340,652 | S | | 10/1993 | Shapiro | |

OTHER PUBLICATIONS

Prior Art Sheet "A"—Institute of Police Technology & Management Traffic Template (No Date).
Prior Art Sheet "B"—Gall's Inc. Traffic Templates (No Date).
Prior Art Sheet "C"—Missouri Uniform Accident Template (No Date).
Prior Art Sheet "D"—Alvin Protracter, Berol Lettering Guide & Pickett Lettering Guide (No Date).

* cited by examiner

*Primary Examiner*—Andrew H. Hirshfeld
(74) *Attorney, Agent, or Firm*—Stephen D. Carver

(57) ABSTRACT

A portable, plastic drawing template for quickly and accurately diagramming traffic intersections and accident scenes while preserving and establishing scaled curblines. Diagrams of intersections made with the disclosed template maintain the desired "square" geometrical relationship between intersecting streets or roads diagrammed. Numerous cutouts in the form of various symbols and shapes enable vehicles, topographical features, and other details to be drawn. The resilient, preferably L-shaped template has a square midsection integral with a pair of outwardly projecting, perpendicularly-oriented legs with calibrated edges. Each leg comprises a dimensioning slot and a projecting slot parallel with and spaced apart from one another for establishing critical drawing points used to align curblines. The template external and internal corners are curved differently to draw arcs of varying curvatures to be fitted to various curblines. Critical inner slots are collinear with critical edges of the template to preserve the resultant "squareness" of the intersection and curblines drawn.

5 Claims, 9 Drawing Sheets

SELF SQUARING ACCIDENT DIAGRAMMING TEMPLATE

BACKGROUND OF THE INVENTION

I. Field of the Invention

The present invention relates generally to the field of accident investigation and analysis. More particularly, the present invention relates to drawing aids and templates that facilitate the accurate diagramming of accident scenes by police officers or other traffic investigators.

II. Description of the Prior Art

It is the usual procedure for investigating police officers to diagram traffic accident scenes in conjunction with routine investigations. During the investigation, a number of measurements are made, witnesses are interrogated, and sketches and notes are accumulated. Afterwards, when the officer leaves the field and returns to headquarters or a substation, a formal report must be made for evidentiary purposes. Usually, for the proper completion of modern accident reports, accurate and detailed diagrams of accident scenes must be provided by an investigating officer. Usually, drawings of accident scenes are made mechanically, with rulers, compasses, protractors, and/or prior art templates. These formal drawings must be accurate and concise, as they will often constitute important evidence that will likely be relevant to both criminal; and/or civil proceedings.

A variety of factors such as weather and road conditions, driver condition, vehicle speed and direction must be evaluated for accurate accident investigation. In collision investigation it is imperative that the point of impact and final rest position of any vehicles involved be recorded accurately. The "point of impact" is often defined as the place where a first "traffic unit" makes inappropriate contact with one or more other "traffic units" or another object, or where the first traffic unit overturns. Traffic units include automobiles, motorcycles, trucks, bicycles, or the like operating within or upon roadways. The rest position of colliding vehicles, for example, can be utilized in conjunction with measurements of skid marks to estimate vehicular speed through the point of impact to the final rest position. Quantitative measurements of skid mark lengths, and intersection dimensions are important. After an accident, the rest position of colliding vehicles provides important evidence. Skid marks at the scene must be measured, and the dimensions of the road or intersection at which the accident occurred must be determined and sketched first hand. Some important evidentiary factors, such as the starting and ending points of critical skid marks, may be marked with nails and/or paint on the highway surface for possible later use in detailed investigations, such as those involving injury accidents or fatalities. Recorded information must be accurate and verifiable for later use. Formal procedures dictate that data integrity is ensured. Once accurate data is accumulated, principles of mathematics and physics may be used with the date to calculate a variety of important parameters.

Although such data is important, time is at a premium at accident sites. The natural inclination is to clear and clean the area of debris, and to move or tow the colliding vehicles to out-of-the way positions. This "clean-up" must be performed efficiently, and quickly if possible, so that the normal flow of traffic is restored. Usually the investigating police officer will make a formal written report relatively soon after an accident, depending upon his or her schedule and other professional obligations. The notes and sketches prepared at the scene are then used to make more detailed, and hopefully more accurate reports and drawings. Such formal documents, if properly and accurately made, provide an excellent basis for meaningful post-accident reconstruction. With prior art system, accident scenes can be drawn with better clarity and accuracy than mere sketches. However, it is important to establish a proper scale of the scene, so that a record of critical measurements and dimensions can be preserved for later evaluation.

Original sketches made at the accident scene, when combined with measurements and other data, can be converted to relatively accurate drawings for the required reports. However, it has hitherto been time consuming and vexatious to prepare properly scaled and dimensioned drawings of complicated roadway features. For example, the proper drawing of intersections can be time consuming and challenging. Where streets or boulevards of varying dimensions and characteristics interest, it is difficult to properly draw the accident scene. Unless the drawing is proportioned or scaled properly, such that the rest position of colliding vehicles is accurately portrayed, opinions extrapolated from the data can be suspect. Complex intersections may involve odd numbers of traffic lanes, varying dimensions between intersection roads, and a variety of other structural or topographical variations.

An important goal is to properly determine and draw the relative widths of adjoining and intersecting traffic lanes. Most intersections form right angles, and so the accurate drawing of such scenes requires a "square" presentation. At the same time, the intersecting lanes must be properly scaled, so that accuracy is insured when the drawing is later relied-upon for evidence.

SUMMARY OF THE INVENTION

This invention provides an efficient and accurate template for diagramming traffic intersections and accident scenes. Diagrams of intersections made with the disclosed template preserve critical proportions, as scaling is facilitated. Moreover, the proper "square" geometrical relationship between intersecting streets or roads diagrammed by the template is maintained. As a result, accurate police records of accident scenes may be quickly and efficiently compiled by investigating officers. These diagrams may be drawn in either a primary scale wherein one inch equals twenty feet, or a secondary scale wherein one inch equals forty feet.

Preferably the template is made of a translucent, plastic material. Vinyl or polycarbonate plastic materials are excellent. Importantly, the template is generally L-shaped. It comprises a square midsection that is integral with a pair of outwardly projecting, perpendicularly-oriented legs. Each leg is substantially square as well. Numerous properly-shaped "voids" or cutouts in the form of various symbols and shapes readily facilitate the drawing of vehicles, trafficway control devices, topographical features, and other important details.

Calibrated inner edges of the template determine proper intersection and curbline dimensions. Besides calibrated edges, each template comprises linear, calibrated drawing slots that facilitate the scaled diagramming of reference points that establish critical roadway and lane dimensions. Each leg has a pair of these critical, internal drawing slots. The "dimensioning" slots are spaced furthest from the midsection, and are used to dimension a roadway and then mark its lanes. Critical "projection" slots are parallel to and spaced apart from the dimensioning slots. The projection slots are positioned closer to the template midsection, parallel with and spaced apart from the dimensioning slots. Further, the projection slots are axially aligned with critical external edges of the template to facilitate drawing of critical projection points along an intersecting roadway to later complete a properly "squared" curbline.

The template further comprises a number of calibrated edges that facilitate the scaling of drawing features. These slots can provide correct scaling where dimensions are important. The template external and internal corners are curved differently to draw arcs of varying curvatures.

Calibrated inner edges of the template determine proper intersection and curbline dimensions. Besides calibrated edges, each template leg comprises a pair of linear, calibrated drawing slots that facilitate the drawing of reference points that establish critical roadway and lane dimensions, and enable the rapid subsequent drawing of curblines. A first straight drawing slot in each leg extends perpendicularly across it. These slots initially dimension a road as a curbline is drawn. A second calibrated slot parallel with the first slot is located towards the innermost portion of the template. These inner slots are collinear with critical edges of the template to preserve the resultant "squareness" of the intersection and curblines drawn.

Thus a basic object is to facilitate the production of accurate accident diagrams.

A related object is to provide a drawing template that aids in the accurate diagramming of intersections and accident scenes.

Another object is to provide a drawing template that is adapted for use in drawing intersections.

A related object is to provide a template of the character describe that makes accurate, scaled drawings.

Another important object is to enable police records to accurately reflect the shape of intersections portrayed in accident investigations. It is a feature of my invention that the proposed template inherently yields drawings of the proper "squareness."

Another basic object is to provide a drawing template of the character described that enables the accurate drawing of intersects, including the adjoining curblines.

A related object is to provide a template that facilitates the drawing of a variety of arcs or curves.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Turning initially to drawing FIGS. 1–4, template 20, has been constructed in accordance with the best mode known to me at this time. The template enables the rapid diagramming and scaling of intersections. It is ideal for producing accurate diagrams in conjunction with proper police investigation reports made, for example, after traffic accidents by the investigating officer.

Figure 5:
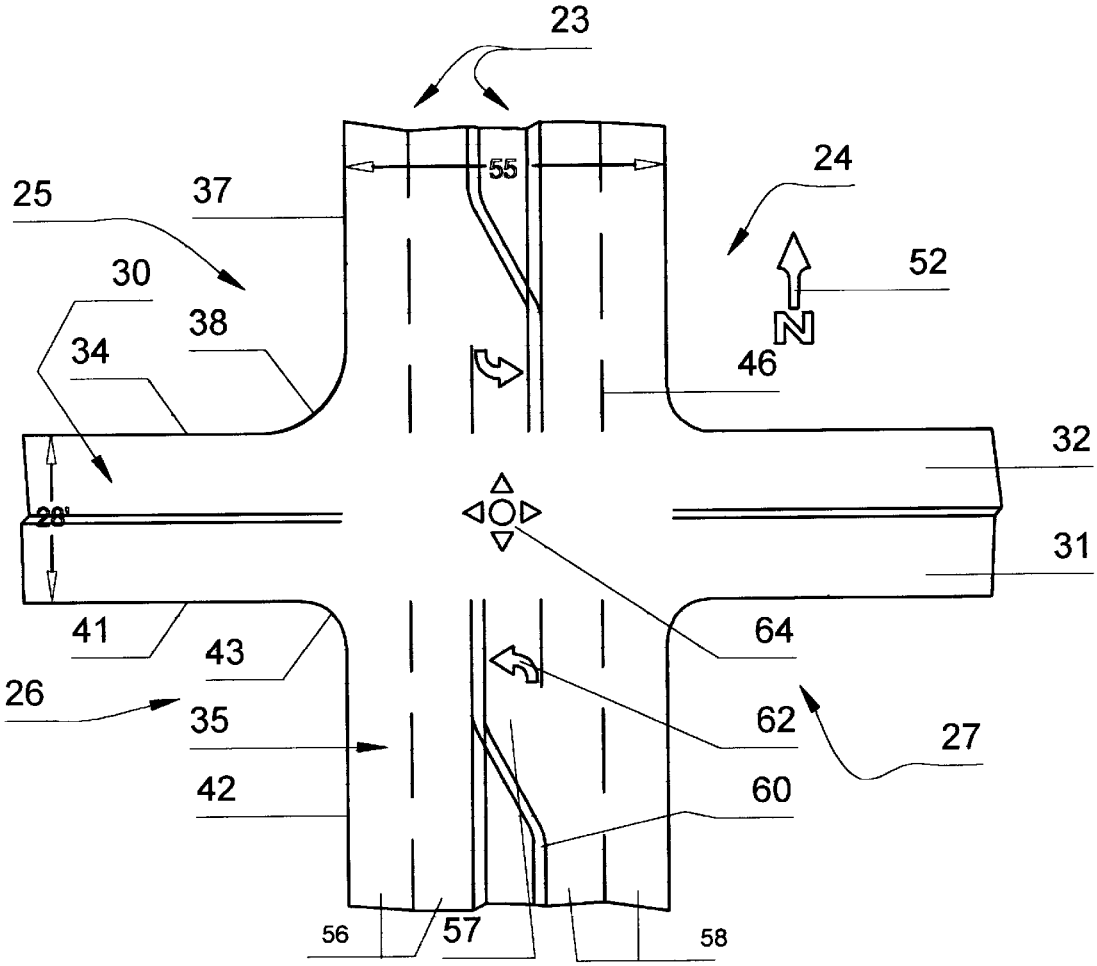
FIG. 5 shows a completed drawing made with my template of a typical right angle intersection wherein one of the intersecting roadways has left turn bays.

FIG. 5 shows a typical intersection 23 to be drawn with the aid of template 20. Intersection 23 comprises a plurality of orthogonally spaced-apart curblines 24, 25, 26 and 27 that generally form the intersection corners. Road 30 comprises a pair of parallel lanes, 31 and 32. The wider intersecting boulevard 35, comprises separate parallel lanes 56, 57, and 58. Importantly, each curbline 24–27 has separate linear segments bordering road 30 and larger boulevard 35. These separate segments are perpendicularly oriented relative to one another, and they are joined by a curved arc forming the middle of each curbline.

For example, curbline 25 (FIGS. 5, 8, 9) is known in the relevant art as the "northwest" curbline. It is traditional in curbline drawing for the direction "North" to be straight up relative to the viewer, as implied by the N-symbol 52 (FIG. 5). Curbline 25 comprises a first, segment 34 bordering road 30 that is generally perpendicular to a second segment 37 that borders boulevard 35. An arc 38 of the proper radius smoothly connects these segments 34 and 37. Similarly, the South-West curbline 26 comprises a horizontal segment 41 adjoining road 30, a vertical segment 42 adjoining boulevard 35, and a central arc portion 43 smoothly connecting linear segments 41 and 42 (FIG. 5).

As indicated by lane marker 60 (FIG. 5) and turning arrow 62, lane 57 is "divided off" into a left-hand turn lane. The four-way traffic light 64 controls traffic from all directions. Intersection 23 comprises curblines 24, 25, 26, and 27 discussed previously. It will be appreciated that, lane marker 60, and turning arrow 62 that are painted onto the intersection surface, can be diagrammed with template 20. Similarly, traffic light 64, which in reality may be suspended above or adjacent the intersection for viewing, and other intersection features, may be traced with the various template cutouts to be hereinafter described. Of course a variety of other intersections exist as well, including "T-intersections," so called forked roadways or "Y-intersections," and other less-common roadway intersections.

After an accident a sketch will be made by the officer or investigator, who will record numerous facts including the impact and final rest locations of the colliding vehicles, the position of scattered debris involved, the names, addresses and summarized statements of eye witnesses, and a variety of other investigative matters of potential evidentiary value. Numerous field measurements are required for accuracy and completeness. Important drawing factors include the width of each roadway and lane, the length of observed skid marks, the radius and type of curb structures involved, the location, type and configuration of traffic control and/or indicator signs, and other parameters required for completeness.

At the station or substation, when the officer or investigator prepares a formal report, his or her field notes and sketches will be utilized to prepare accurate diagrams. Template 20 enables the officer or investigator to make these diagrams quickly and efficiently. At the accident scene a crude sketch resembling FIG. 5 will be made. The crude sketches will later enable the investigator to properly diagram the intersection through the use of my template.

Figure 1:
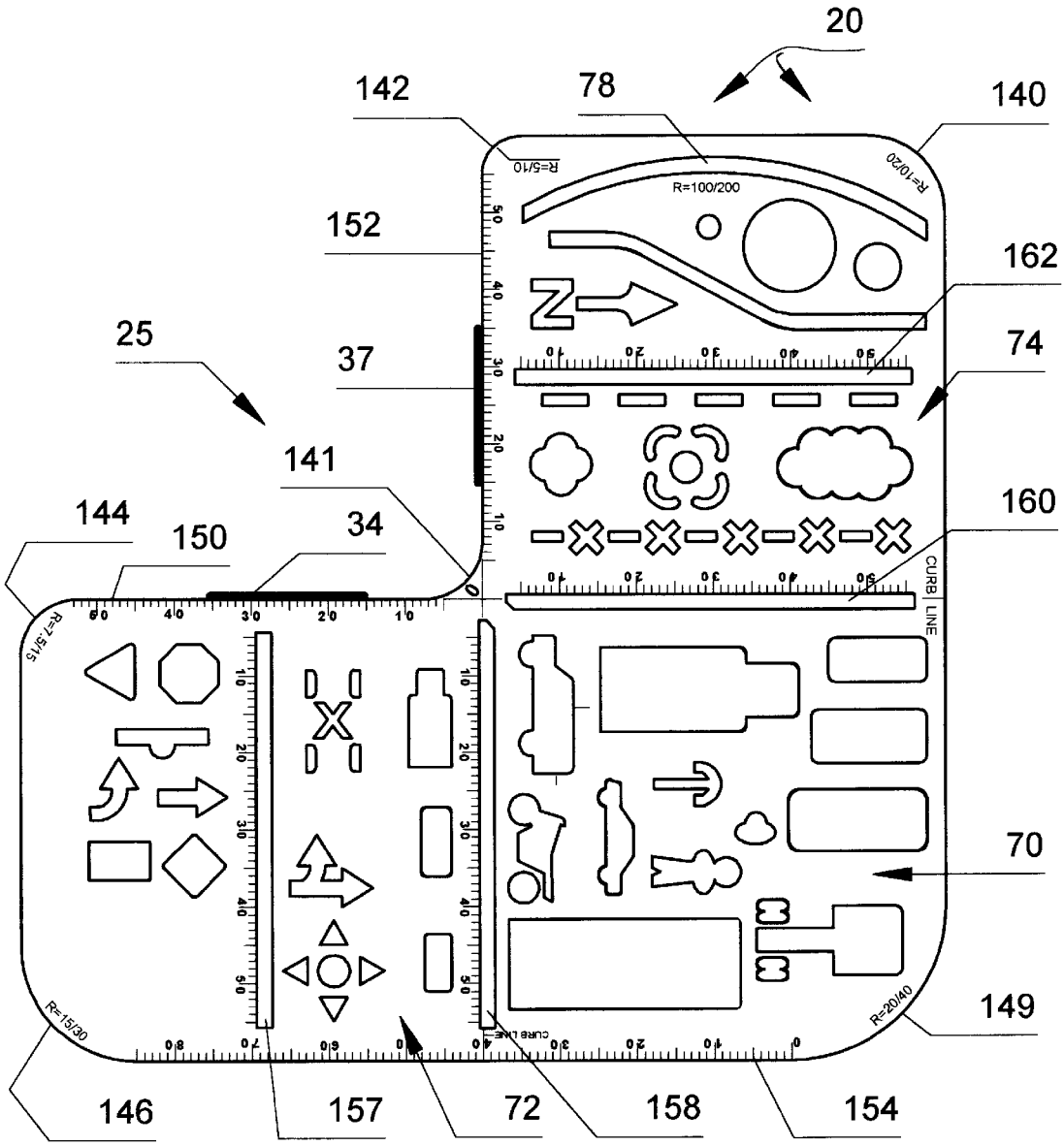
FIG. 1 is plan view of the preferred template, with it positioned to initially draw the north-west curbline in an intersection.
Figure 2:
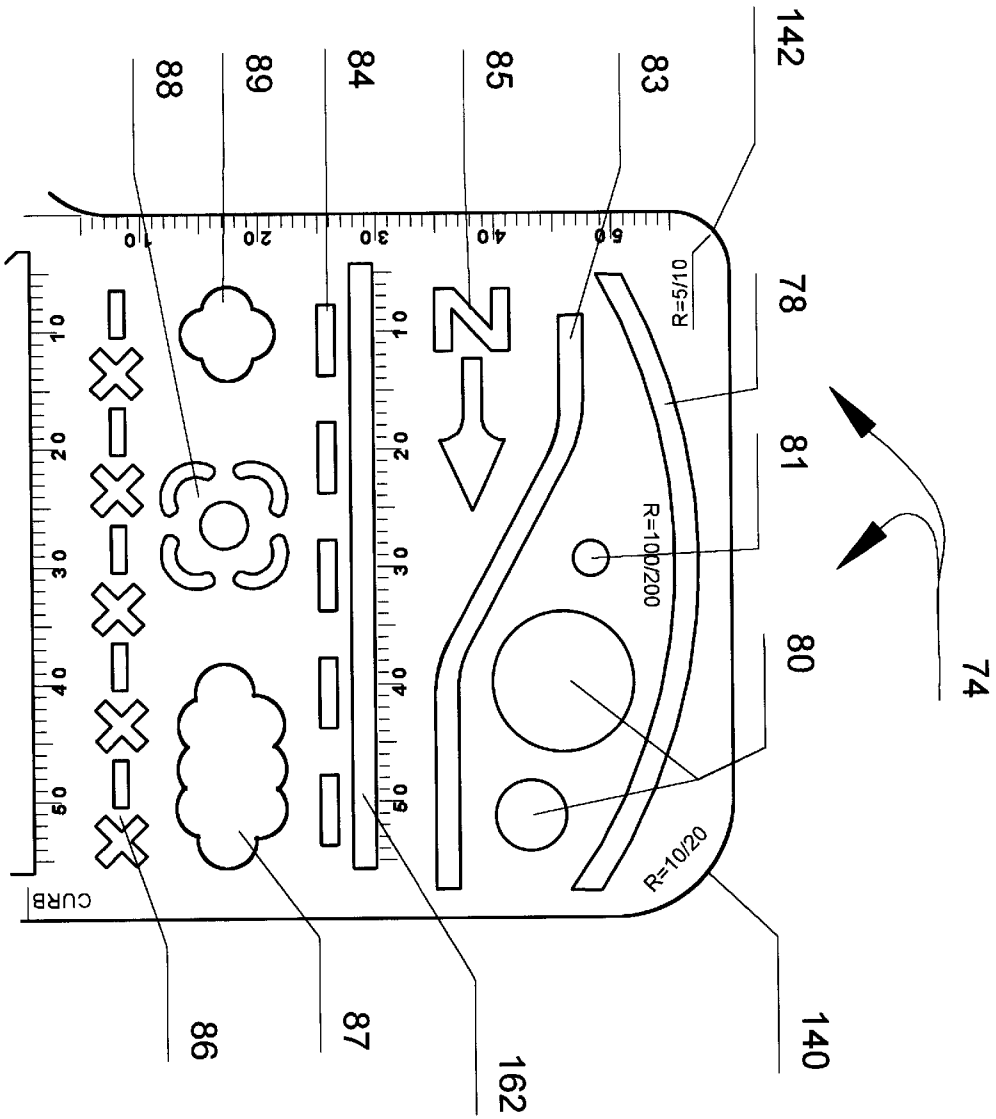
FIG. 2 is an enlarged, fragmentary plan view of one leg of the template.
Figure 3:
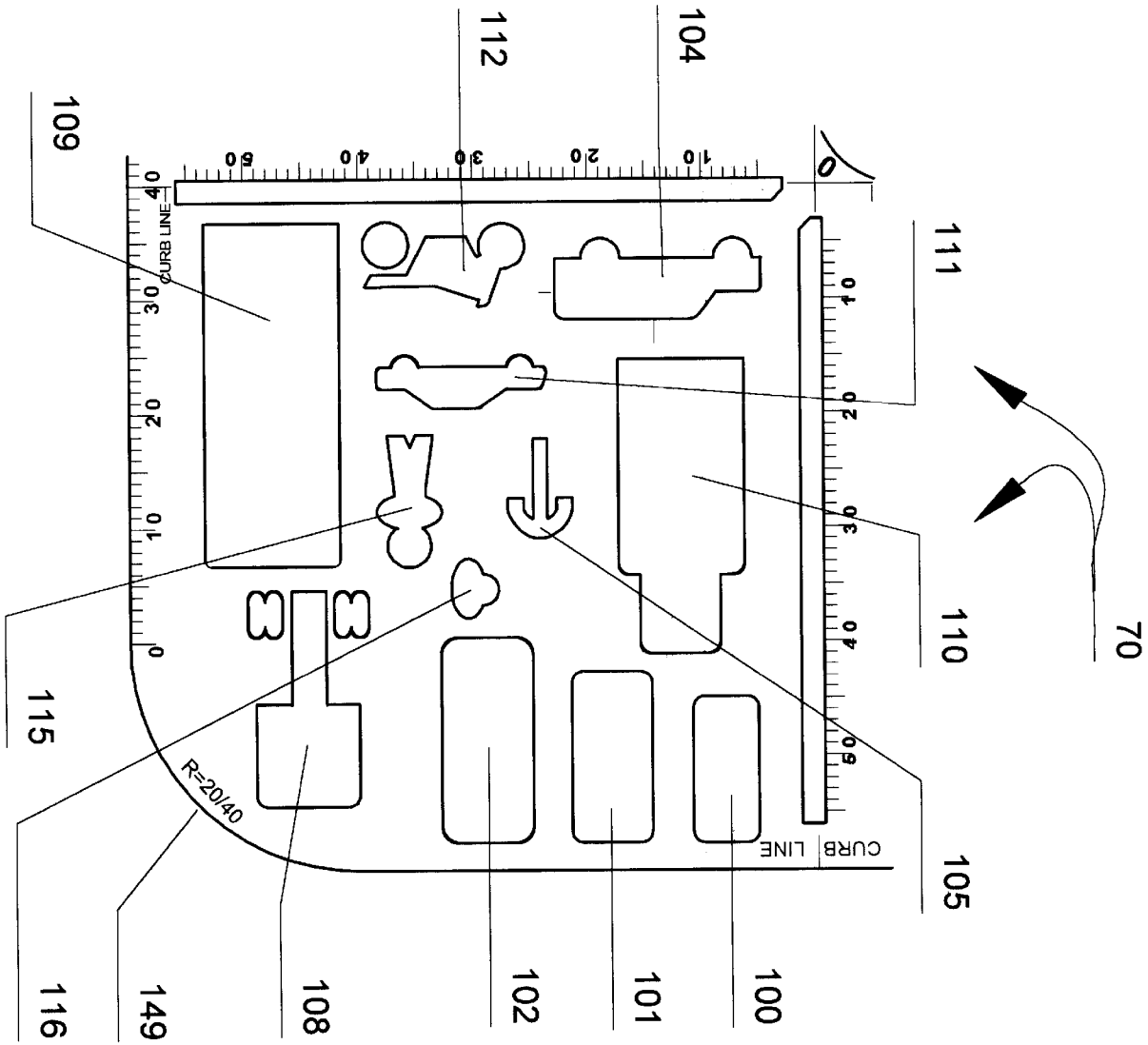
FIG. 3 is an enlarged fragmentary plan view of the template midsection.

With primary emphasis on FIGS. 1–4, the preferred template 20 is generally L shaped, and flat. Preferably it is made of translucent, lightly colored vinyl or polycarbonate plastic that is approximately 0.020 to 0.050 inches thick. In the best mode known to me at this time, it is made of rigid, translucent tinted vinyl approximately 0.030 inches thick. It comprises a somewhat square midsection 70 (FIGS. 1, 3) that is integral with a pair of intersecting legs 72 (FIGS. 1, 4) and 74 (FIGS. 1, 2). In the best mode midsection 70 is approximately 3.0 inches by 3.0 inches. Legs 72 and 74 are also square, and preferably they measure approximately 3.0 inches by 3.0 inches as well.

There are many cutouts in the form of various symbols to be discussed later that are formed in the template for tracing. Calibrated edges have been provided for making scaled drawings. The straight, calibrated internal slots to be discussed hereinafter enable accurate "squaring" when the curblines are drawn, and correct scaling where the dimensions of road features such as lanes are important. Various template corners are radiused differently to enable the proper drawing of arcs of varying curvatures.

Leg 74 (FIG. 2) comprises a number of cutouts corresponding to "roadway" and "topographical" features. The large radius curve 78 is for drawing miscellaneous portions of gradually curved streets or roads. The various circular cutouts 80, 81, can be used for drawing items with circular cross sections, such as utility poles, columns, etc. The segmented or irregular slot 83 is useful for diagramming irregular road segments, such as left turn bays 60 seen in FIG. 5. The "N" cutout 85 (FIG. 2) and its associated arrow quickly enable the drawing of a direction reference point 52 (FIG. 5). The "chain" 86 comprising a series of "x's" and dashes is used to draw fences. Cutouts 87, 88, and 89 respectively enable the drawing of shrubs, trees, and bushes. A linear series of cutouts 84 enable the drawing of lane dividers, such as dividers 46 of FIG. 5. Cutouts 84 are parallel with an important dimensioning slot 162 to be described later.

Midsection 70 (FIG. 3) of the template 20 comprises a number of cutouts for drawing pedestrians and various vehicles. Cutouts 100, 101, and 102 respectively designate small, medium, and large automobiles or light trucks. Cutout 104 designates an "SUV" or pickup truck turned onto its side. Cutout 105 provides a symbol used for sketching a top view of motorcycles or bicycles. A tractor trailer rig may be drawn with cutout 108, and its trailer results from cutout 109, which can also be used to draw the top view of a bus. Cutout 110 applies to smaller commercial trucks. Automobiles on their sides are drawn with cutout 111. Motorcycles or bicycles are drawn with cutout 112. A pedestrian lying on the ground at an accident final resting place may be drawn with cutout 115. Cutout 116 is used to draw the impact or pre-impact position of a pedestrian involved in an accident.

Template leg 72 (FIG. 4) has drawing cutouts 120, 121, 124 and 125 for a number of common traffic signs. Cutouts 122, 123 are used for drawing painted lane traffic directional symbols. Cutout 126 is used for drawing the top view of street signs. Cutout 127 is for double-use lane pavement markings. Cutout 129 yields a four-way traffic light. Cutout 132 is used to diagram a fully-overturned vehicle in conjunction with cutouts 100, 101, or 102. Symbols 134, 135 and 136 respectively designate commercial, large, and medium vehicles in a reduced scale where one inch equals forty feet.

Importantly, the "inner" and "outer" corners' of template 20 are radiused to draw radiuses of different curvatures. The outer corners 140 and 142 of leg 74 (FIG. 2) respectively provide scale radii of 10/20 and 5/10. In this nomenclature the first figure represents the curve in a scale where one inch equals twenty feet. The second figure represents the curve in a scale where one inch equals forty feet. Thus corner 140 that is marked 10/20 can draw an arc whose radius is ten feet where the scale is one inch for twenty feet; similarly it can draw an arc whose radius is 20 feet where the scale is one inch to forty feet.

Outer corners 144 and 146 of leg 72 (FIGS. 1, 4) respectively provide scale radii of 7.5/15 and 15/30. The outer corner 149 (FIG. 1, 3) provides a scale radius of 20/40. Importantly there is an inner corner 141 (FIG. 6) of a 7.5/15 scale radius. The 7.5 foot radius in the one inch to twenty foot scale is the most common average curbline radius encountered. The latter radius is quite common in drawing curblines, and it is used to draw curblines 26, 27, and 24 in intersection 23 (FIG. 5) as will hereinafter be explained. The 1:40 scale is mainly for those simple accident scenes where you have a basic intersection with no topographical features and no special conditions. All of the measuring scales are labeled in the 1:20, however, you only need to double the number to get the 1:40 scale.

The inner edge 150 of leg 72 (FIG. 1) is perpendicular to the inner edge 152 of leg 74 (FIG. 1). Both of these marked edges are calibrated with a proportional, linear scale marked from zero (i.e., within corner 141) to fifty-five. The longer external template edge 154 seen at the bottom of FIG. 1 is calibrated from zero to eighty. It provides a linear, calibrated ruler-like straightedge for drawing. The calibrated inner edges are used to determine proper dimensions of an intersection, and to establish critical squareness as will hereinafter be described. In addition to the calibrated edges, each template leg comprises a pair of linear, calibrated drawing slots that are critical to the initial drawing of a curbline.

Figure 4:
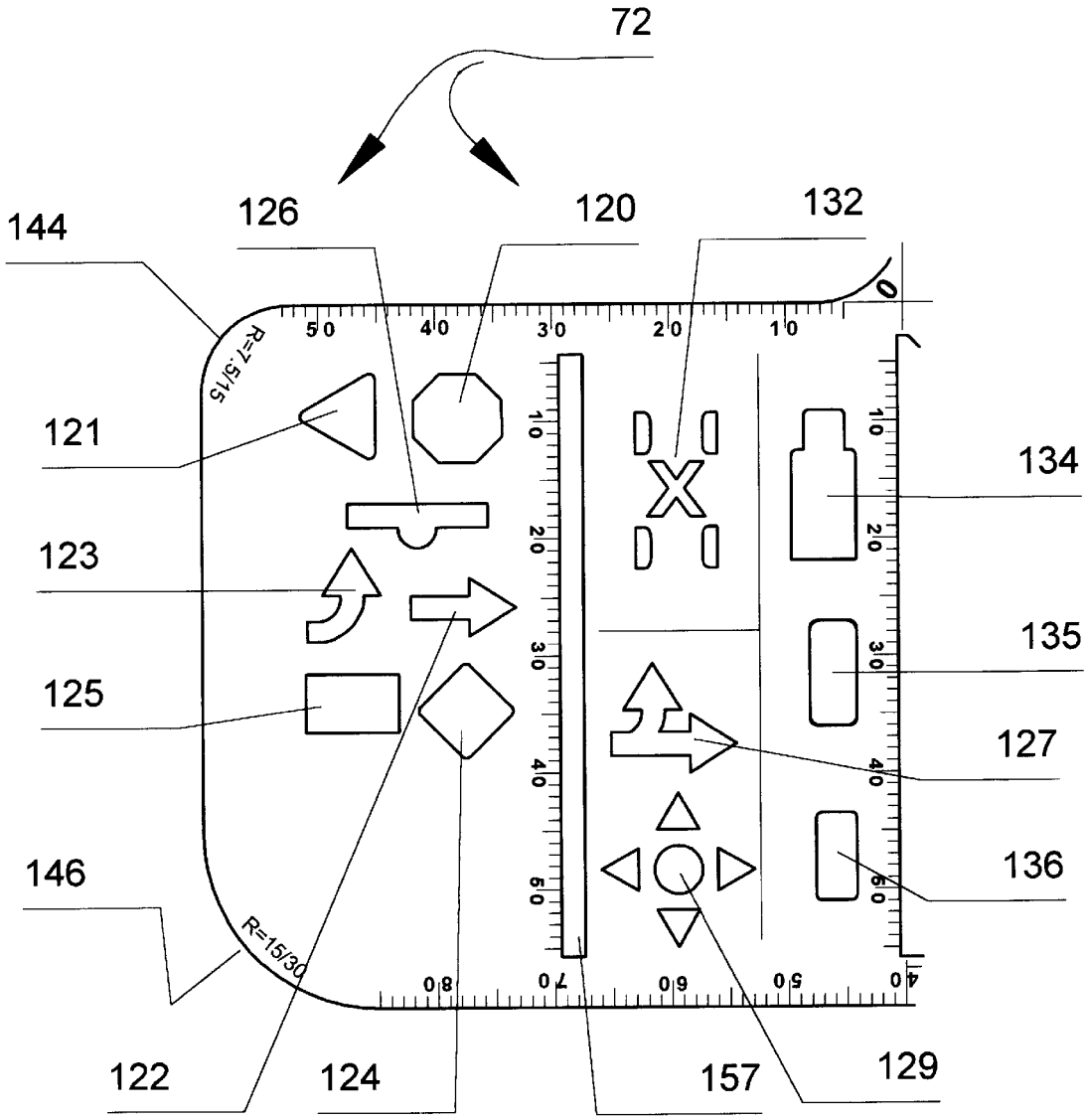
FIG. 4 is an enlarged fragmentary plan view of the other template leg.

Leg 72 comprises a pair of related, parallel, straight drawing slots. A dimensioning slot 157 extends perpendicularly across the leg, terminating short of edges 150, 154 (FIGS. 1, 4). Dimensioning slot 157 can initially dimension a road to be associated with a curbline, by determining its scaled width, and locating its lanes. In other words, once the first linear segments of a first curbline to be diagrammed are drawn, the dimensioning slot may be used to mark the lanes and proportional width of one of the intersecting roadways bounding the first curbline. As explained in more detail later, at least one first reference point can be drawn to establish a distance corresponding to street width. Secondly, a calibrated projecting slot 158 is spaced apart from and parallel with dimensioning slot 157. Preferably the projecting slot 158 is collinear with edge 152 of leg 74 described previously. Edge 152, by way of example, will aid in drawing a segment of a curbline. Substantially concurrently with the drawing of the last mentioned curbline, projecting slot 158 can be used to mark a point that will aid in the drawing of the edges of the second intersecting roadway, for reasons that will latter become apparent.

Leg 74 preferably comprises its own projecting slot 160 and dimensioning slot 162. These parallel drawing slots are similar in function and structure to dimensioning slot 157 and projecting slot 158 discussed above. Slots 160, 162 formed in leg 74 are oriented perpendicularly with respect to the orientation of slots 157 and 158.

Accident diagrams are preferably drawn at headquarters or at a substation, on a convenient desk or surface. Field notes and sketches of the intersection to be drawn will be referenced considerably. By way of example, to start drawing an intersection, such as intersection 23 (FIG. 5), template 20 may be initially positioned as in FIG. 6. Curbline segments 34 and 37 (seen completed in FIG. 5) are first drawn as in FIG. 7 with suitable pens or pencils 177. It will be appreciated that these segments are drawn perpendicular to one another, and the developing skill of the officer will be used to determine the proper arc to be drawn between them. It will be appreciated that it is most convenient to use inner corner 141, and the template has been constructed with this most common curbline arc formed in scale. However, the template may be moved to "fit" larger or smaller curvatures by positioning other curved corner portions 140, 144, 146 or 149 (FIG. 1) to smoothly interconnect line segments 34 and 37 to yield the arc 38 completing the first curbline 25 in FIG. 5.

Figure 6:
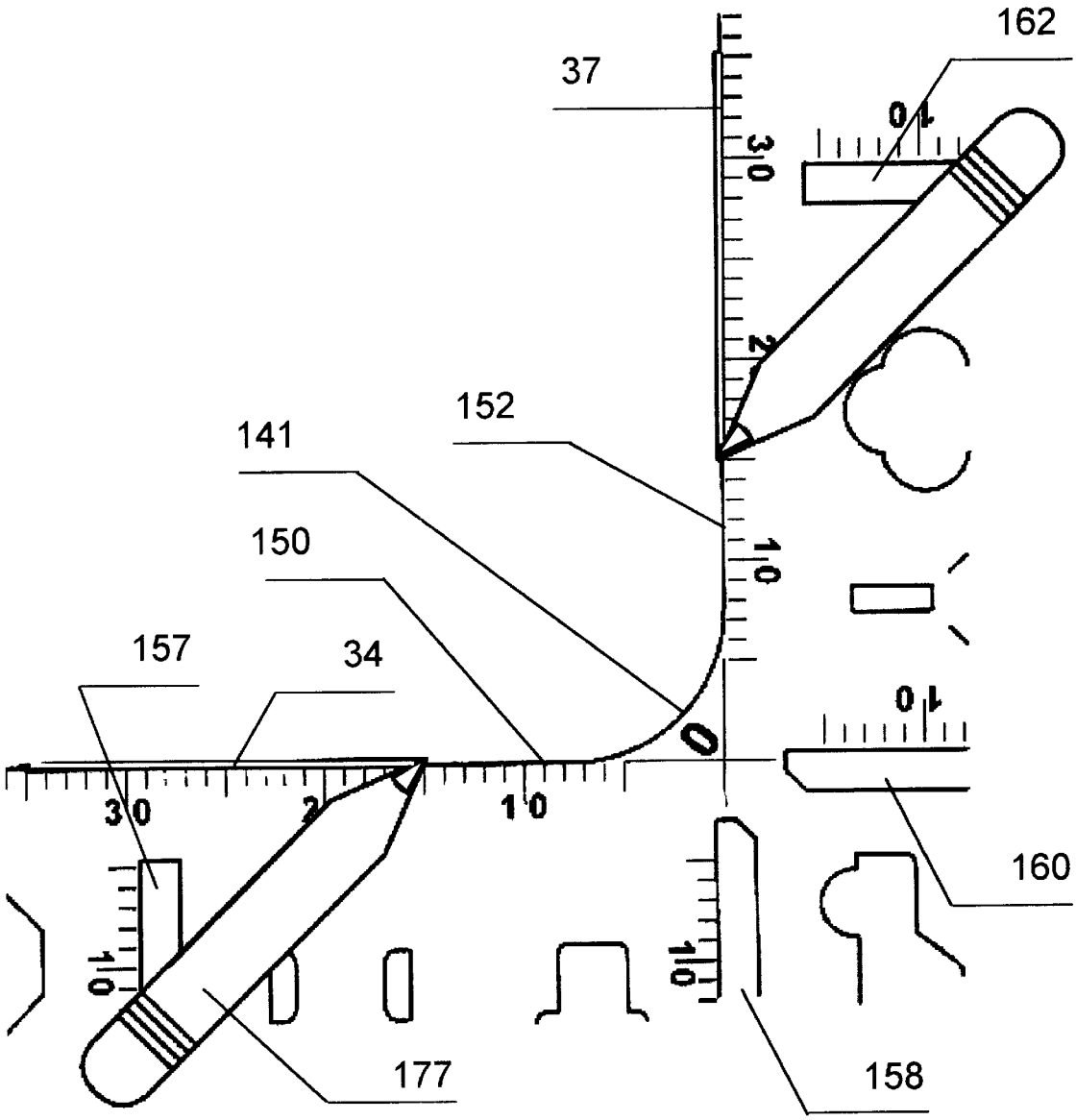
FIG. 6 is an enlarged, fragmentary diagrammatic view showing the initial drawing of curbline linear segments preliminary to the drawing of a first curbline forming an intersection.
Figure 7:
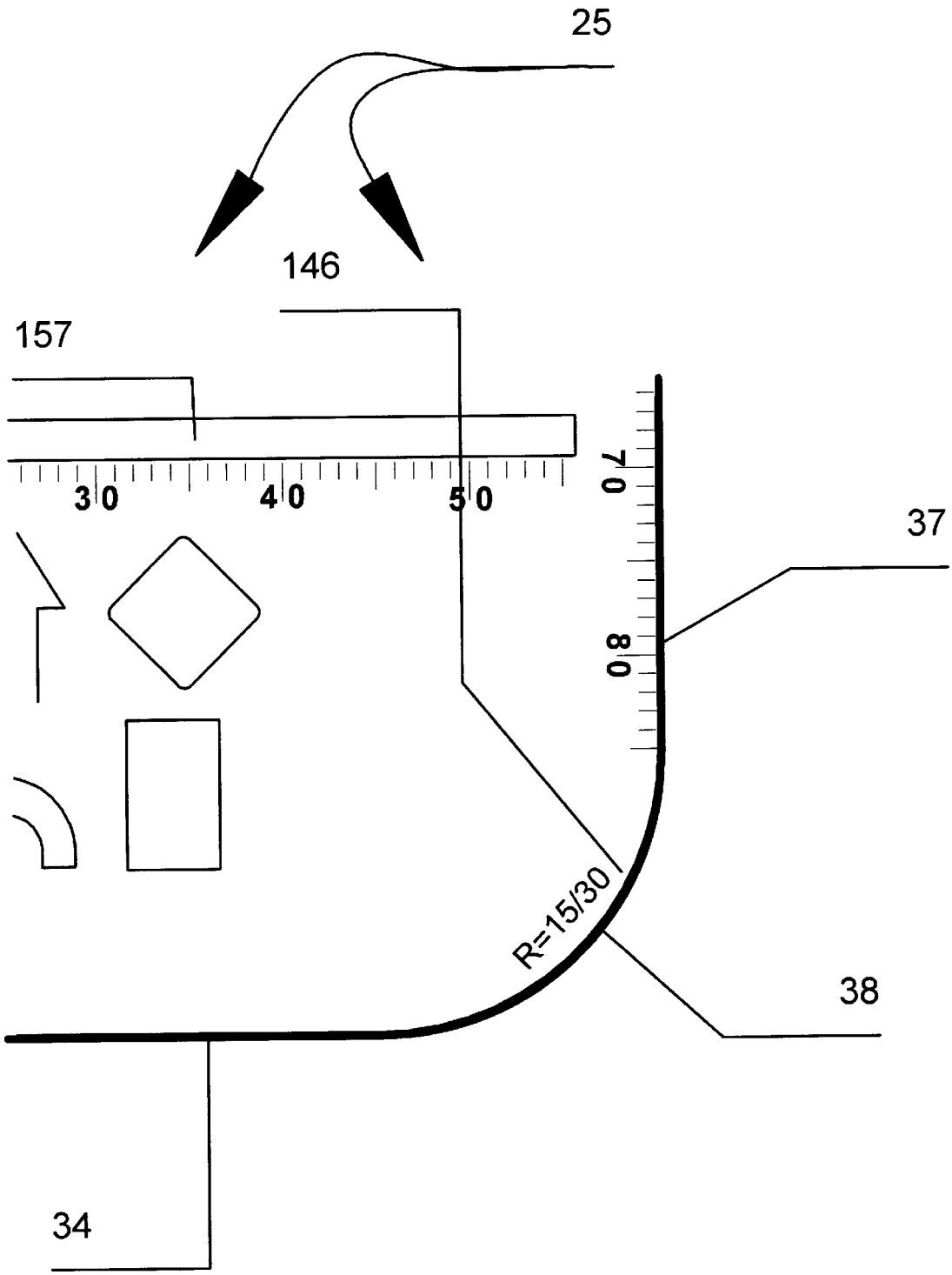
FIG. 7 is an enlarged, fragmentary diagrammatic view showing a selected corner section of my template that establishes a properly-radiused curbline arc that completes the first curbline started in FIG. 6.

It will be noted that the curbline segments 37 and 34 as illustrated in FIG. 6 terminate at points along the calibrated edges 152, 150 respectively of the template at points marked "15" on the calibrated scale. In this example the officer is seeking to draw an arc with a fifteen foot radius for curbline 25. With only line segments 34 and 37 drawn as in FIG. 6, template corner curve 146 (FIG. 7) is "fitted" to the line segments 34 and 37 to draw an arc 38 of the desired radius "15/30." This provides a fifteen foot radius on a one-inch to twenty-foot scale. Alternatively, for example, where the curbline to be drawn has a more common 7.5 foot radius, the inner corner 141 (FIG. 6) could have been used to diagram the curbline without moving the template. Inexperienced or beginning users will most often draw curblines by using inner corner 141 at the middle of the legs juncture, so that less template movements are required and speed is increased. But more advanced accident investigators will more precisely draw very accurate curblines with proportional radius's correctly drawn to scale by utilization of one of the many template corners 140, 142, 146, 144, or 149.

Figure 8:
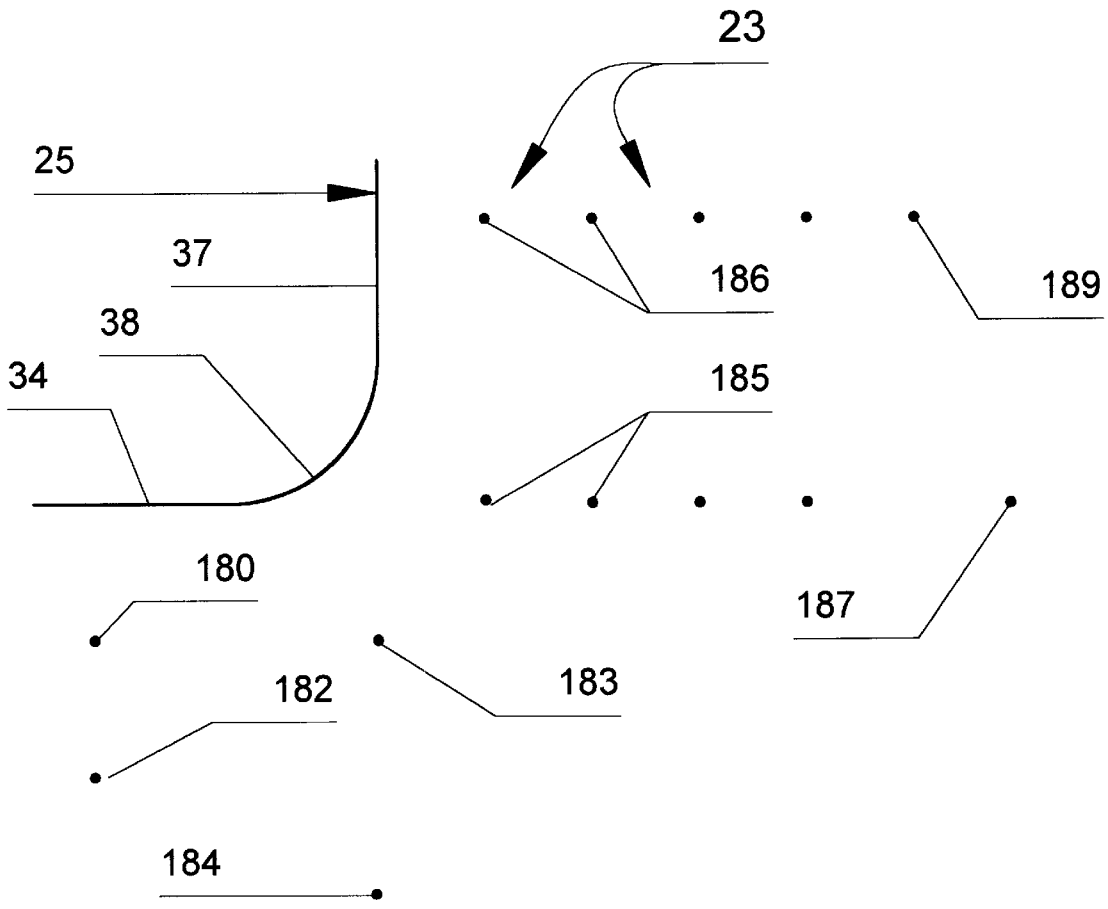
FIG. 8 is a diagrammatic view of a partially completed drawing made with my template, which when completed, results in a drawing resembling that depicted in FIG. 5.

With the template still positioned to draw curbline 25 as in FIG. 8, first points 180 and 182 are drawn with the aid of dimensioning slot 157. These respectively proportionally establish the lane width and the road width. Subsequent points 183 and 184 are drawn with projecting slot 158. Point 183 establishes lane width. Point 184 spaced away from point 183 will establish a side of the boulevard 35 that will align vertically with segment 37 (FIG. 8). This is because projecting slot 158 is collinear with template edge 152 (FIG. 1), and projecting slot 160 is preferably collinear with edge 150. Concurrently points 186 may be drawn within dimensioning slot 162 to establish the lane widths of boulevard 35. Similarly, point 189 is drawn within dimensioning slot 162 to establish boulevard width.

Points 185 (FIG. 8) can be drawn within projecting slot 160 to determine lane widths. They will squarely align with points 186 described previously. Further, points 185 will form a line that is coincident with line segment 34 described previously. Point 187 can be drawn within projecting slot 160 to show a projection of curbline segment 34, that will align with and form the horizontal segment of the yet-to-be-drawn North-East quadrant curbline. Then the template may be positioned to sketch curbline 26 (i.e., the South West quadrant) by rotating it until edge 152 (FIG. 1) aligns with point 182 (FIG. 8) and template edge 150 aligns with point 184 (FIG. 8). When so aligned, curbline 26 can be drawn. Concurrently, points 190 and 192 are drawn within projecting slot 158, and points 191 and 196 are drawn with the aid of dimensioning slot 157.

Figure 9:
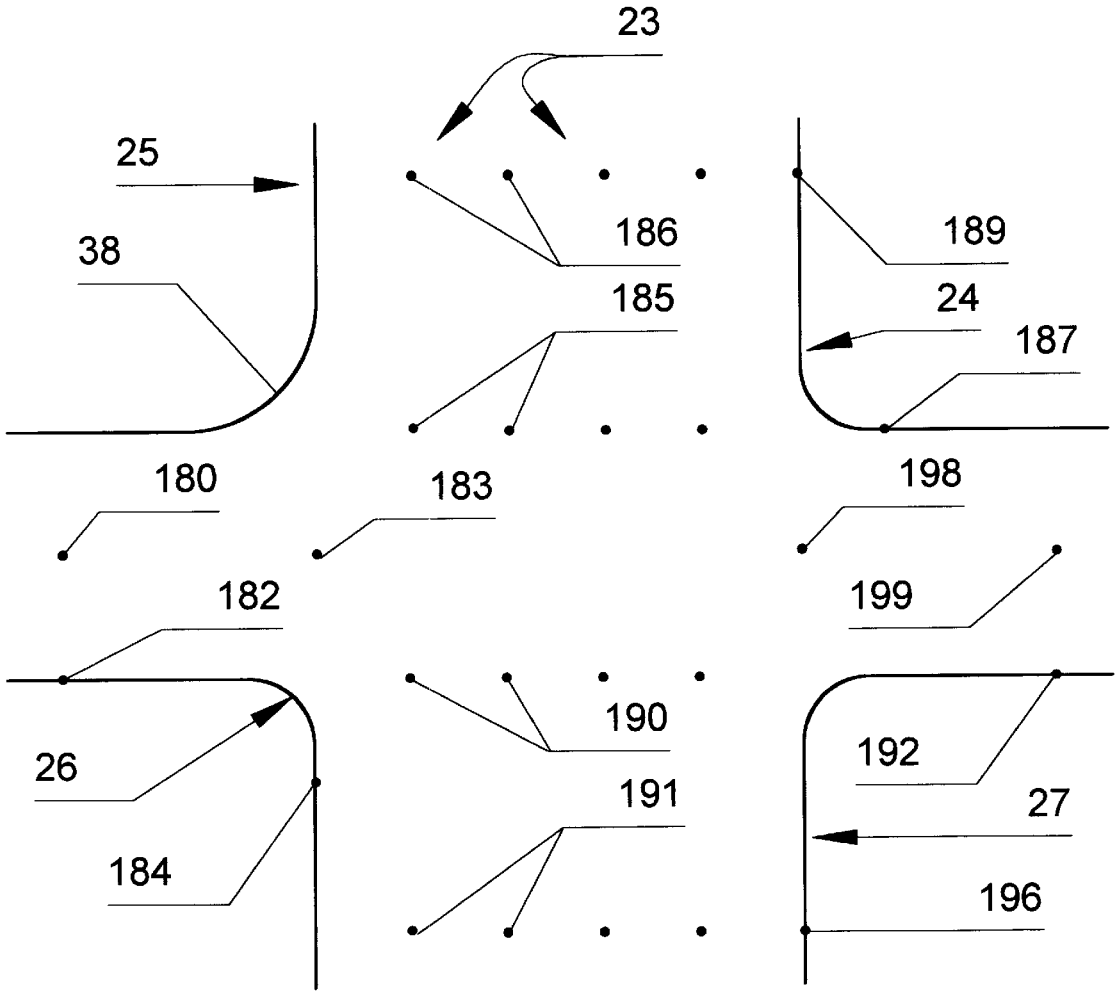
FIG. 9 is a diagrammatic view of a partially completed drawing that adds detail to the drawing of FIG. 8, which when completed, results in a drawing resembling that depicted in FIG. 5.

The template 20 is then rotated ninety degrees counterclockwise. By gently sliding it into a position such that edges 150 and 152 respectively abut points 196 and 192, the third curbline 27 results (FIG. 9). At this time points 198 and 199 can be drawn with slots 158 and 157 respectively. Points 198 and 199 determine lane width. Next the fourth intersection curbline 24 is drawn by again rotating the template, and aligning the edges with points 189 and 187 drawn previously.

Because of the construction of the straight drawing slots 158, 157, 160, 162, and the relative proportions thereof, a perfectly square intersection will be drawn. Once an intersection is drawn, the various template cutouts described previously can be used to add detail. For example, the rest position of colliding vehicles can be easily drawn with the various aforedescribed vehicular cutouts. Traffic control signs, vegetation, and other features may be sketched in with the template as desired, as indicated in FIG. 5.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

Having thus described my template invention, I claim:

1. A portable template for making scale drawings of traffic intersections where first and second streets meet, the drawings comprising at least two curblines, each curbline comprising first and second segments corresponding to intersecting street edges and connected by an arc of a predetermined radius corresponding to a corner of the intersection to be drawn, said template comprising:

first and second intersecting legs comprising first and second perpendicular inner edges enabling the drawing of the curblines, one leg inner edge enabling the drawing of the first segment of each curbline to be drawn and the other leg inner edge enabling the drawing of the second segment of each curbline to be drawn, the second segment of each curbline being perpendicular to the first segment thereof;

at least one curved portion enabling the smooth drawing of said arcs between said first and second segments of each curbline;

wherein the first leg comprises a first calibrated projecting slot extending across it in axial alignment with the inner edge of the second leg, and the second leg comprises a second calibrated projecting slot extending across it in axial alignment with the inner edge of the first leg, said first leg having a calibrated dimensioning slot extending across it at a location between the first calibrated projecting slot and the free end of the first leg, said second leg having a calibrated dimensioning slot extending across it at a location between the second calibrated projecting slot and the free end of the second leg, said projecting and dimensioning slots for establishing reference drawing points to which the leg edges may be thereafter fitted for proportionally drawing subsequent curblines; and a plurality of curved outer corners; and a plurality of cutouts defined in the template to be used as a guide for drawing traffic symbols, road markers, road signs, obstacles, and vehicles.

2. A portable template for making scale drawings of traffic intersections where first and second streets meet, the drawings comprising at least two curblines, each curbline comprising first and second segments corresponding to intersecting street edges and connected by an arc of a predetermined radius corresponding to a corner of the intersection to be drawn, said template comprising:

first and second intersecting legs comprising first and second perpendicular inner edges enabling the drawing of the curblines, one leg inner edge enabling the drawing of the first segment of each curbline to be drawn and the other leg inner edge enabling the drawing of the second segment of each curbline to be drawn, the second segment of each curbline being perpendicular to the first segment thereof;

at least one curved portion enabling the smooth drawing of said arcs between said first and second segments of each curbline;

wherein the first leg comprises a first calibrated projecting slot means extending across it in axial alignment with the inner edge of the second leg, and the second leg comprises a second calibrated projecting slot means extending across it in axial alignment with the inner edge of the first leg, said first leg having a calibrated dimensioning slot means extending across it at a location between the first calibrated projecting slot and the free end of the first leg, said second leg having a calibrated dimensioning slot means extending across it at a location between the second calibrated projecting slot means and the free end of the second leg, said projecting and dimensioning slots means for establishing reference drawing points to which the leg edges may be thereafter fitted for proportionally drawing subsequent curblines; and a plurality of curved outer corners; and a plurality of cutouts defined in the template to be used as a guide for drawing traffic symbols, road markers, road signs, obstacles, and vehicles.

3. The template as defined in claim 2 wherein said legs are joined at a vertex in a smooth curve for drawing said arcs.

4. The template as defined in claim 2 wherein the legs are joined at a vertex in a smooth curve, wherein said arcs may be drawn with proper curvature by using any one of said outer corners or said vertex as a guide.

5. A method for making properly scaled and squared traffic accident drawings depicting intersections where first and second streets meet to form four curblines, each curbline comprising first and second segments connected by an arc of a predetermined radius, the method comprising the steps of:

providing a portable template comprising:

a first leg with a first edge and a second leg with a second edge, the first and second legs perpendicularly intersecting one another at a vertex;

at least one curved portion enabling the smooth drawing of said arc between said first and second segments;

a first calibrated dimensioning slot and a first calibrated projection slot defined in said first leg, the first dimensioning slot being spaced apart from and parallel with the first projection slot;

a second calibrated dimensioning slot and a second calibrated projection slot defined in said second leg, the second dimensioning slot being spaced apart from and parallel with said second projection slot; and, a plurality of cutouts to be used as a guide for drawing traffic symbols, road markers, road signs, obstacles, and vehicles; and, constructing the accident scene upon a suitable sheet or form by executing the preliminary steps of:

drawing a first line corresponding to the first segment of a first of the curblines to be drawn with said first edge as a guide;

drawing a second line corresponding to the second segment of the first curbline to be drawn with said second edge as a guide, the second line perpendicular to the first line;

without moving the template, drawing a first point within said first dimensioning slot corresponding to the width of said first street forming said intersection;

without moving the template, drawing a third line within said first projection slot corresponding to an edge of said second street and forming the first segment of a second of the curblines;

without moving the template, drawing a second point within said second dimensioning slot corresponding to the width of said second street forming said intersection;

without moving the template, drawing a fourth line within said second projection slot corresponding to an edge of said first street and forming the first segment of a third of the curblines;

without vertically lifting the template, rotating the template approximately 90 degrees so that said third line abuts said first edge and said first point abuts said second edge;

without moving the template, drawing a fifth line through the first point against said second template edge, the fifth line comprising the second segment of the second curbline;

without moving the template, drawing a third point within said first dimensioning slot corresponding to the width of said second street forming said intersection;

without moving the template, drawing a sixth line within said first projection slot corresponding to an edge of said first street and forming the first segment of a fourth of the curblines;

without vertically lifting the template, rotating the template approximately degrees from the last position so that said sixth line abuts said first edge and said third point abuts said second edge;

without moving the template, drawing a seventh line through said third point along said second template edge thereby forming the second segment of said fourth curbline;

without vertically lifting the template, rotating the template approximately 90 degrees from the last position so that said fourth line abuts said second template edge and said second point abuts said first template edge;

without moving the template, drawing an eighth line through said second point along said first template edge thereby forming the second segment of said third curbline; and, finishing construction of the accident scene by executing, in any desired order, the final steps of:

connecting the first and second lines to form said arc for said first curbline, thereby finishing the first curbline;

connecting the third and fifth lines to form said arc for said second curbline, thereby finishing the second curbline;

connecting the fourth and eighth lines to form said arc for said third curbline, thereby finishing the third curbline;

connecting the sixth and seventh lines to form said arc for said fourth curbline, thereby finishing the fourth curbline; and, drawing a plurality of traffic symbols, road markers, road signs, obstacles, and vehicles upon said diagram using said cutouts in said template.

* * * * *